US005737861A

United States Patent [19]

Hansen

[11] Patent Number: 5,737,861

[45] Date of Patent: Apr. 14, 1998

[54] INTERMITTENT MOTION GEAR BOX

[75] Inventor: Don Hansen, Anaheim, Calif.

[73] Assignee: Tri Motion Design, Inc., Alamo, Calif.

[21] Appl. No.: 636,875

[22] Filed: Apr. 23, 1996

[51] Int. Cl.[6] ..... G09F 11/02

[52] U.S. Cl. ..... 40/505; 74/84 R

[58] Field of Search ..... 40/502, 503, 504, 40/505; 74/84 R, 416, 412, 436

[56] References Cited

U.S. PATENT DOCUMENTS

| | | | |
|---|---|---|---|
| 215,810 | 5/1879 | Eaton | 74/434 |
| 1,462,047 | 7/1923 | Ray | 40/505 |
| 5,161,421 | 11/1992 | Stigsson | 40/505 |
| 5,416,996 | 5/1995 | Clemens et al. | 40/502 |
| 5,511,330 | 4/1996 | Havens | 40/505 |

FOREIGN PATENT DOCUMENTS

| | | | |
|---|---|---|---|
| 14160 | of 1900 | United Kingdom | 40/505 |

*Primary Examiner*—Cassandra Davis
*Attorney, Agent, or Firm*—James G. O'Neill

[57] ABSTRACT

A simplified gear box for intermittently displaying a number of displays on a display apparatus is comprised of a partial gear driven by a drive shaft, the partial gear cooperates with a number of pins on a rotatable pin wheel which is secured to a triangular shaped display element so as to intermittently rotate the display element upon rotation of the pin wheel. A number of gear boxes are connected to a number of triangular elements to intermittently synchronously rotate all of the triangular display elements, to display different images upon a face of the display apparatus.

5 Claims, 2 Drawing Sheets

INTERMITTENT MOTION GEAR BOX

BACKGROUND OF THE INVENTION

1. Field of the Invention

This invention relates generally to intermittent motion means, and more particularly, to an improved gear box for providing intermittent motion to devices, such as display apparatus showing a number of different display images.

2. Description of Related Art

U.S. Pat. No. 5,416,996 to Clemens et al. ("'996"), discloses a display apparatus, for showing a number of different display images, having a housing and a plurality of triangular display elements rotatably mounted therein. Each of the display elements includes a first, second and third major side and is suspended for rotation about an axis. The '916 patent also discloses a drive assembly which may have an intermittent motion gear between a drive motor and an output shaft to provide a start-stop effect and intermittently show the three sides of the triangular display elements. The contents of the '916 patent is incorporated herein, in its entirety, by this reference thereto.

The '991 patent describes and shows an improved system for displaying different display images as the various sides of each of the display elements is turned. Furthermore, it describes one means for intermittently driving these display elements. However, problems may occur in the intermittent drive assembly disclosed therein, and it is costly to use and/or maintain. Therefore, there exists a need in the art for a simple, low cost and easy to manufacture and use means for intermittently driving rotatable display elements, or the like.

SUMMARY OF THE INVENTION

Accordingly, it is a general object of the present invention to provide an improved intermittent motion means. It is a particular object of the present invention to provide an improved intermittent motion means which is easy to manufacture, assemble and service. It a still more particular object of the present invention to provide an improved intermittent motion means which may be easily installed in existing devices. It is yet another particular object of the present invention to provide an improved intermittent motion assembly having a reduced number of parts. It is still a further particular object of the present invention to provide an improved intermittent motion means for rotating display elements. And, it is still another particular object of the present invention to provide an improved intermittent motion means in the form of a gear box assembly which may be used in existing or new installations and driven by a common drive shaft to intermittently drive a plurality of triangular display elements so as to show different images.

These and other objects and advantages of the present invention are achieved by providing a gear box means driven by a drive means. the gear box means has a partial driven gear therein, with at least one tooth, for intermittently driving a pin wheel means attached to a rotatable display means having a plurality of surfaces.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified intermittent drive means.

Figure 2:
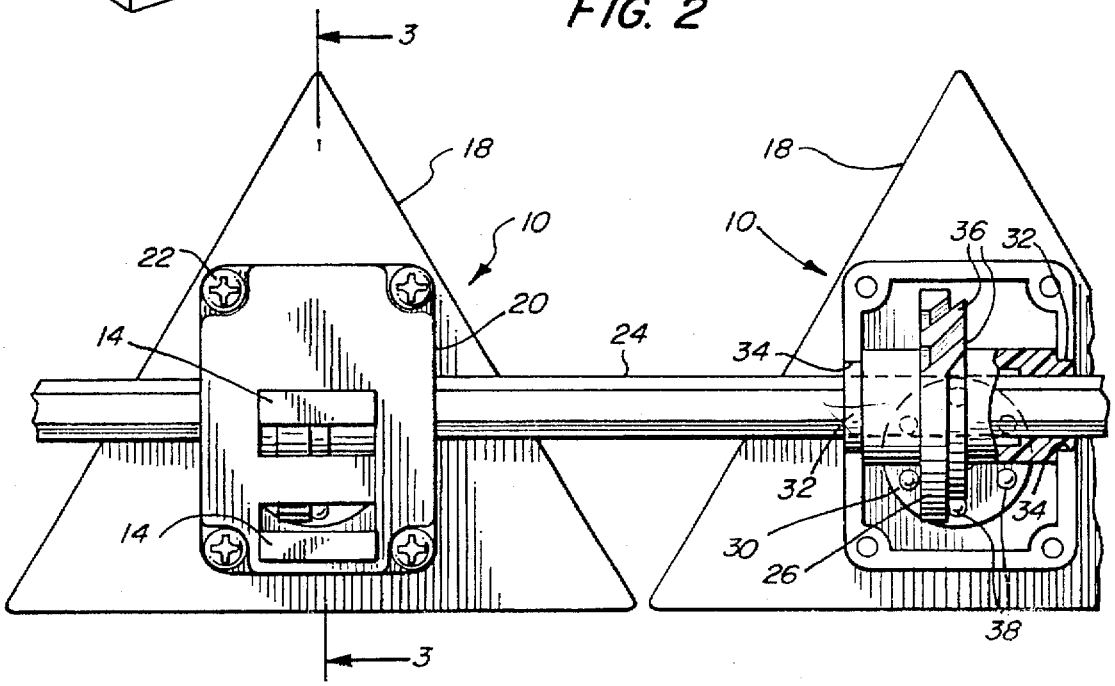
FIG. 2 is a partial cross-sectional view taken along line 2—2 in FIG.1.
Figure 3:
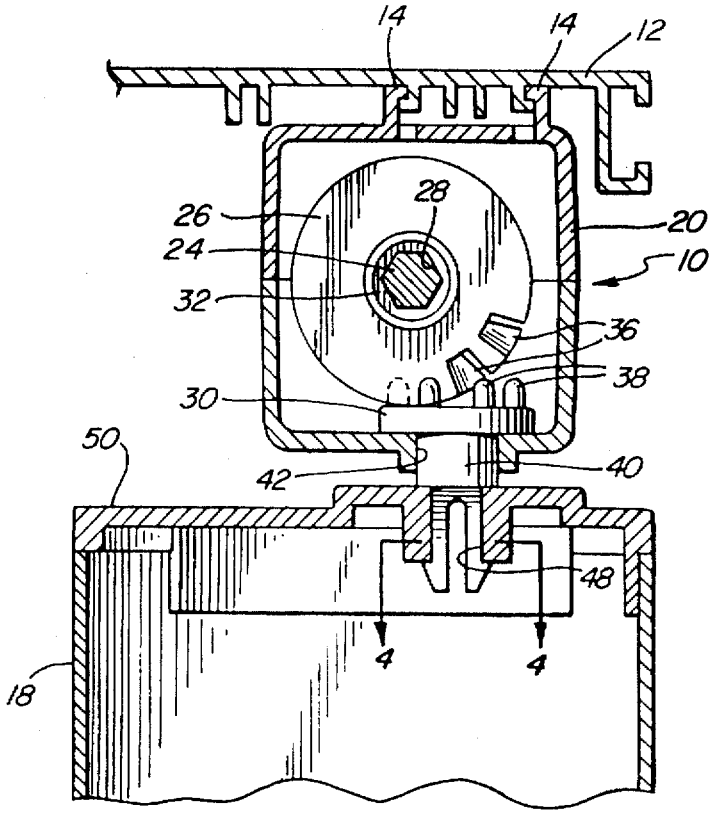
FIG. 3 is a partial cross-sectional view taken along line 3—3 in FIG.2.
Figure 4:
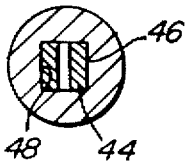
FIG. 4 is a cross-sectional view taken along line 4—4 in FIG. 3.

Referring now to the drawings, and in particular FIGS. 2 and 3, there shown is a preferred embodiment of the simplified intermittent drive means 10 of the present invention. The intermittent drive means 10 is illustrated as being in the form of a gear box assembly, although it is to be understood that it may take any other desired shape or form which may be used to provide intermittent motion to a device. Additionally, for illustrative purposes only, the intermittent drive means 10 is described herein as being used to drive triangular display elements, such as those disclosed and claimed in the '916 patent.

Preferably, a plurality of intermittent gear box drive means 10 are removably mounted in a track housing, or the like 12, and may be held therein in any convenient manner, such as by means of a pair of "L" shaped arms 14 formed on a housing 20 and cooperating with similar type holding track means formed within the track housing channel, in a manner well known to those skilled in the art.

Figure 1:
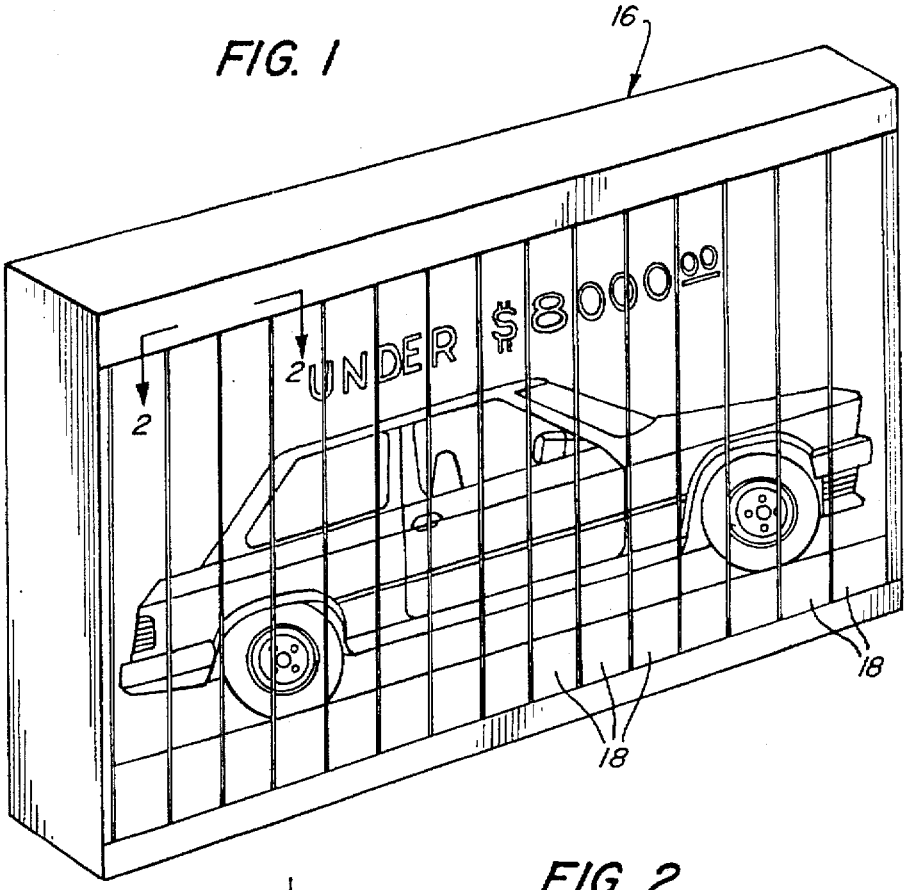
FIG. 1 is a perspective view of a display apparatus containing the intermittent drive means of the present invention.

Turning now to FIG. 1, there shown is a representative display apparatus 16 in which the present invention may be used. This display apparatus 16 has a face and a frame with a plurality of triangular display elements 18, rotatably mounted therein, as described in the '996 patent. However, the intermittent gear box drive means 10 of the present invention provide a simplified and more efficient device to replace both the separate intermittent motion gearing elements and the separate individual gear boxes, having complete spur and worm gear means therein, as disclosed in the '996 patent, for intermittently driving each of the triangular display elements 18, or similar devices. That is, each of the triangular display elements 18 shown in FIG. 1 will have a separate intermittent gear box drive means 10 attached thereto, as shown in FIG. 2. Each of these intermittent gear box drive means 10 includes an outer housing 20, which may be integrally formed from any material, such as plastic, but which preferably includes at least two separate sections held together by securing means, such as screws 22. Each of the intermittent gear box drive means 10 is connected to and driven by a common or single drive shaft 24, passing therethrough. The drive shaft 24 is driven or rotated in any desired manner, as by a motor or manual means (not shown). The drive shaft 24 may be formed from any desired material, and may take any desired shape, but preferably is formed from a metal or a hardened plastic so as to have a plurality of surfaces thereon which positively mate with, and drive, drive or operating means held within the outer housing 20. As shown, the drive or operating means preferably comprises a substantially circular, partial gear or wheel means 26, having a central opening 28 therein, shaped to mate with the drive shaft 24. It is to be understood that the drive or operating means 26, may take any other desired shape, having a cam-type operating means thereon, for intermittently driving or turning a driven means 30, such as a pin wheel. Pin wheel 30 has a plurality of spaced apart pins 38 formed on a top or upper thereof. Although any number of pins may be used, in the preferred embodiment shown in the drawings, six equally spaced apart pins 38 are used. The partial gear wheel 26 is rotatably mounted within the outer housing 20, as by bearing means 32 secured thereto and rotatably secured within circular openings 34 formed between the separate sections of the housing. The partial gear wheel 26 is formed so as to include at least one cam, gear or tooth means 36, but preferably includes two such cam, gear or tooth means 36, so as to more positively engage and drive pins 38 secured on pin wheel 30, one or more pins at a time, as described more fully below. The number of pins 38 on pinwheel 30 and the spacing there-between, as well as the size of the pin wheel 30 and cooperating teeth 36 and cam wheel 26 are selected to provide a smoothly operating device which has the desired delay between rotation of the sides of the triangular elements of the display apparatus. That is the number, sizes and dimensions may be easily calculated using methods known to those skilled in the art. Therefore, each element of the intermittent drive means of time present invention is sized and dimensioned so as to provide the best performance possible in sequentially presenting a series of images on a face of display apparatus 16, after predetermined time delays.

As is best shown in FIG. 3, the pin wheel 30 is preferably substantially circular and includes or is secured to a lower shaft portion 40, rotatably mounted within an aperture 42 formed in a lower wall of housing 20. A securing means 44, such as a slotted hook, is secured to a lower surface of shaft portion 40 and is coupled to one of the triangular display element 18 to intermittently drive the display element to which it is coupled. This coupling may take any desired means, such as a notched member held in a slotted means secured to a cap, of the type set forth in the '916 patent. Or, the securing means 44 may have a plurality of flat sides 46, and be frictionally and releasably held within a similarly shaped aperture 48, formed in an end cap 50 secured to one end of the triangular display element 18. In this manner, each of the triangular shaped elements 18 will be positively and synchronously rotated by drive shaft 24, through rotation of the drive means 26 and a respectively connected pin wheel 30, when either or both teeth 36 contact and move one of the pins 38.

Figure 5:
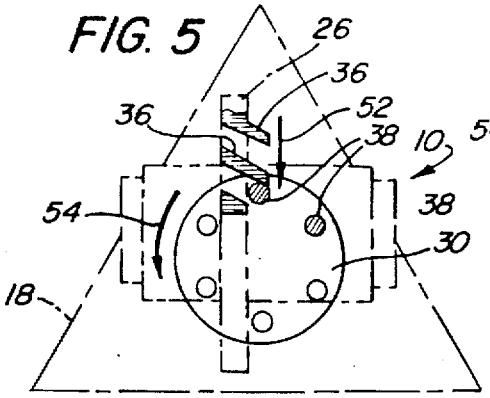
FIGS. 5 through 7 are schematic representational views showing how the preferred embodiment of the present invention operates.
Figure 6:
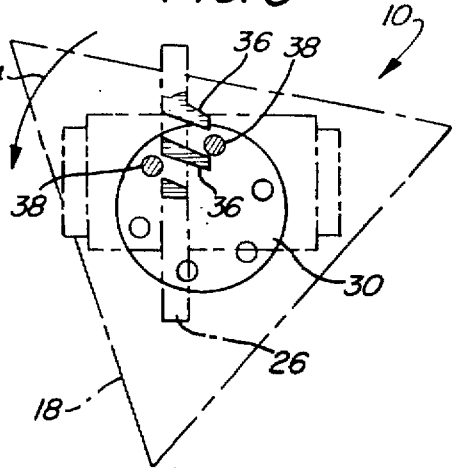
Figure 7:
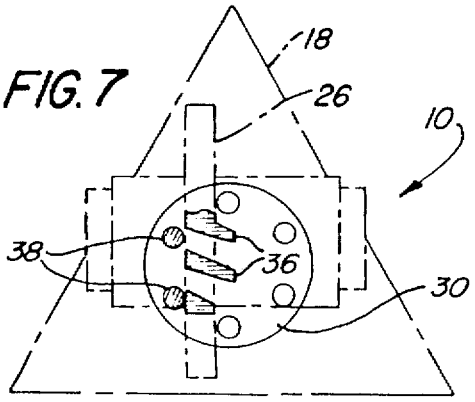

Turning now to FIGS. 5 through 7, the operation of the intermittent motion means of the present invention will be explained more fully. It may easily be seen that the one or more teeth 36 of partial gear 26 act as a cam means to move a pin 38, to thereby rotate the pin wheel means 30 and connected triangular shaped element 18. Looking first at FIG. 5, and in particular, the shaded pins 38 and cam means or gear teeth 36, on rotation of the partial gear wheel 26, by rotation of the drive shaft 24, the teeth 36 will be moved in the direction of the arrow 52, i.e., downwardly when looking at FIGS. 5 through 7, until a first cam or tooth 36 contacts a first shaded pin 38. On contacting this first shaded pin 38, the first tooth 36 will move the first pin, counterclockwise, or in the direction of the arrow 54 shown in FIGS. 5 and 6, this motion will also move the second shaded pin 38 to the position shown in FIG. 6 where this second pin will then be moved by the second tooth 36 to the position shown in FIG. 7, thus rotating the triangular element 18 attached to the pin wheel by the securing means 44, to a further side thereof. Thereafter, on each complete rotation of the partial gear wheel 26 the gear teeth 36 will contact a further pair of pin means 38 so as to rotate the triangular shaped element again. It is to be understood, and is obvious when looking at the drawings, particularly FIG. 2, that the gear wheel 26 is positioned off center of a horizontal axis of the housing 20, i.e., to the left as shown in FIG. 2. Additionally, so as to properly mate with the gear wheel 26, the pin wheel 30 is positioned off center of a vertical axis of the housing 20, i.e, to the right as shown in FIG. 3. In this manner, each time the teeth 36 engage a pair of pins 38 there will be consistent, smooth rotation of the attached triangular element 18. Additionally, it is obvious that a motor or other drive means connected to and rotating drive shaft 24 will synchronously rotate each of the triangular elements connected to an intermittent gear means 10, so as to serially show at least three separate displays on the face of display apparatus 16 shown in FIG. 1.

Thus, there has been described an improved and simplified device for intermittently driving display elements and, in particular, triangular display elements to show a variety of display images on the display apparatus in a sequential timed manner. The device of the present invention eliminates the need for separate intermittent motion and gear box means, thereby simplifying the operation of the display apparatus, and lowering both the initial cost and maintenance costs thereof over its lifetime.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than what is specifically described herein.

What I claim is:

1. A display device having a plurality of display surfaces, comprising, in combination:

a plurality of triangular shaped display elements;

a plurality of gear boxes mounted in said display device;

each of said plurality of gear boxes having a separate housing divided into two parts;

each of said plurality of gear boxes having a partial gear drive means rotatably supported therein:

each of said partial gear drive means having a shaft and being rotatably supported between said two parts of said separate housing by bearing means carried on said shaft;

operating means connected to each of the shafts of said partial gear drive means to synchronously drive each of said partial gear drive means;

each of said shafts is hollow and is shaped so as to mate with said operating means extending therethrough;

pin wheel driven means rotatably mounted in each of said separate housings at an angle of 90 degrees to the respective partial gear drive means held therein;

each of said pin wheel driven means having an upper surface with a plurality of pins thereon and a lower surface with a securing means connected thereto and extending through an opening formed in said separate housing; and each of said plurality of triangular shaped display elements being connected to one of said securing means on the lower surface of a pin wheel driven means, whereby said operating means will intermittently move said plurality of triangular shaped display means in said display device.

2. The display device of claim 1 wherein each of the hollow shafts is formed with a plurality of flat surfaces which mate with corresponding flat surfaces formed on said operating means.

3. The display device of claim 1 wherein each of said partial gear drive means has two gear teeth formed thereon.

4. The display device of claim 3 wherein each of said pin wheel driven means has six pins secured thereto.

5. The display device of claim 4 wherein upon each complete rotation of each of said plurality of partial gear driven means by said operating means, said two gear teeth will contact a pair of said pins on said pin wheel driven means to rotate said pin wheel driven means.

* * * * *